United States Patent [19]

Kündig

[11] Patent Number: 4,606,744

[45] Date of Patent: Aug. 19, 1986

[54] METHOD AND APPARATUS FOR LIQUEFYING A LOW-BOILING GAS

[75] Inventor: Andres Kündig, Stafa, Switzerland

[73] Assignee: Sulzer Brothers Limited, Winterthur, Switzerland

[21] Appl. No.: 659,444

[22] Filed: Oct. 10, 1984

[30] Foreign Application Priority Data

Jul. 20, 1984 [CH] Switzerland ..... 3550/84

[51] Int. Cl.[4] ..... F25J 3/00

[52] U.S. Cl. ..... 62/22; 62/38; 62/40

[58] Field of Search ..... 62/9, 11, 22, 38, 39, 62/40

[56] References Cited

U.S. PATENT DOCUMENTS 3,098,732 7/1963 Dennis ..... 62/40

3,864,926 2/1975 Collins ..... 62/9

*Primary Examiner*—Frank Sever

*Attorney, Agent, or Firm*—Kenyon & Kenyon

[57] ABSTRACT

The apparatus for liquefying helium gas comprises a pre-cooling stage and a cooling stage in which the high pressure gas from the pre-cooling stage is divided into at least two sub-flows. One sub-flow is expanded with the performance of work to a first intermediate pressure while a second sub-flow passes through a heat exchanger and is then expanded with the performance of work to a second intermediate pressure. The sub-flows may thereafter be separately passed through a further heat exchanger or combined for simultaneous passage through the heat exchanger prior to being further expanded and cooled in a throttle valve or turbine. The partially liquefied flows are then delivered to a tank from which the low-temperature return flow can be passed back through the cooling stage to the pre-cooling stage for re-cycling.

16 Claims, 4 Drawing Figures

METHOD AND APPARATUS FOR LIQUEFYING A LOW-BOILING GAS

This invention relates to a method and apparatus for liquefying a low-boiling gas. More particularly, this invention relates to a method and apparatus for liquefying helium gas.

Heretofore, various types of methods and apparatus have been used for liquefying low-boiling gas such as helium gas. In addition, it has also been known to produce a refrigeration effect in the temperature range of the gas in the liquid state. For example, as described in Swiss Pat. No. 592,280, one known apparatus has been constructed so that the entire flow of a high-pressure gas is directed from a pre-cooler through a cooling stage having two heat exchangers and an expansion machine disposed between the two exchangers with the flow passing successively through the exchangers and expansion machine. However, such an apparatus has a limited thermodynamic efficiency.

Accordingly, it is an object of the invention to be able to produce a liquefied low-boiling gas at a high thermodynamic efficiency.

It is another object of the invention to be able to use generally conventional structure in order to bring about the liquefaction of a low-boiling gas in a simple and efficient manner.

Briefly, the invention provides a method and apparatus of liquefying a low-boiling gas in a circuit.

The apparatus includes a pre-cooling stage for producing a high pressure gas flow at a pre-cooling temperature, a cooling stage for cooling the high pressure flow to close to the temperature of liquefied gas, which cooling stage includes a plurality of counter-current heat exchangers and a plurality of expansion means, and a low temperature consumer for receiving at least some liquefied gas from the cooling stage and for re-cycling a low-pressure gas flow to the cooling stage.

In accordance with the invention, a first means is providing for directing the high pressure gas flow from the pre-cooling stage through a first heat exchanger in the cooling stage. In addition, a second means is provided for passing a first sub-flow of the high pressure gas flow through a first expansion means in the cooler for expansion therein, at least two other heat exchangers in the cooler for cooling the expanded gas flow in counter-current to a flow of the low-temperature gas flow therein and a second expansion means in the cooler for expansion therein prior to delivery to the consumer. Still further, a third means is provided for passing a second sub-flow of the high pressure gas flow through two heat exchangers in the cooler for cooling in counter-current to the flow of low-temperature gas, a third expansion means between the two heat exchangers for expansion therein and a further expansion means for expanding the gas flow prior to delivery to the consumer.

In one embodiment, the means for directing the high pressure gas flow from the pre-cooling stage is in the form of a feed line which connects the pre-cooling stage directly to the first heat exchanger of the cooling stage. In addition, the second means includes a branch line connecting the first heat exchanger to the first expansion means as well as a plurality of lines which sequentially connect the two heat exchangers and the second expansion means. The third means includes a second plurality of lines which connect the first heat exchanger, the two heat exchangers through which the second sub-flow passes and the third expansion means. In this embodiment, the two sub-flows pass in parallel from the cooler to the consumer.

In a further embodiment, a common means such as a throttle valve or expansion turbine, forms the second expansion means for each of the sub-flows in order to pass the two sub-flows to the consumer together.

In still another embodiment, a branch line is connected between the pre-cooler and cooler in order to convey a third sub-flow of the high pressure gas flow to a gas turbine in order to expand this sub-flow. In addition, a line connects the gas turbine to the second means for conveying the first sub-flow through the cooler downstream of the first expansion means therein. Again, in this embodiment, a common means may be used to form the expansion means for the combined sub-flow passing from the cooler.

In accordance with the method of liquefying the low-boiling gas, the high pressure flow from the pre-cooler is passed through a first of the heat exchangers in the cooler, is divided into two sub-flows with one sub-flow being expanded in a first expansion machine to a first intermediate pressure with the performance of work while the second sub-flow is directed through a second of the heat exchangers. Thereafter, the two sub-flows are passed through a third of the heat exchangers simultaneously and separately from one another. Thereafter, the second sub-flow is passed through a second expansion means for expansion to a second intermediate pressure with the performance of work while the first sub-flow is passed through a fourth heat exchanger. Next, the two sub-flows are passed through a fifth heat exchanger simultaneously and separately from one another and each is expanded in a separate expansion means to the pressure of the low-pressure flow with at least some liquid gas being formed and fed to the low-temperature consumer.

As a modification of this method, the first and second intermediate pressures may have the same value while the two sub-flows pass through the fifth heat exchanger in combination and are then expanded in a common throttle valve.

These and other objects and advantages of the invention will become more apparent from the following detailed description taken in conjunction with the accompanying drawings wherein.

Figure 1:
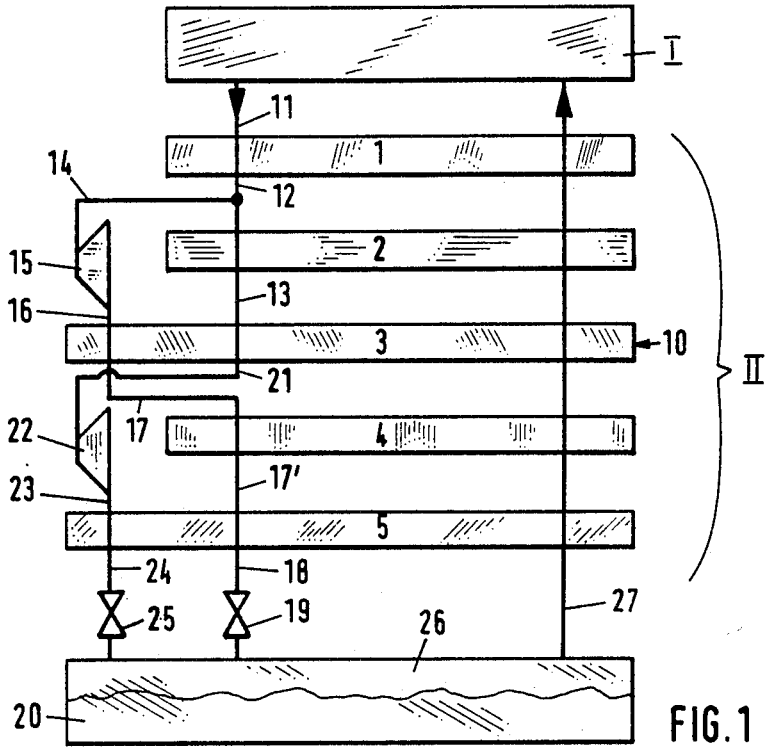
FIG. 1 illustrates a flow diagram of one apparatus constructed in accordance with the invention.

Referring to FIG. 1, the apparatus for liquefying a low-boiling gas such as helium gas includes a pre-cooling stage I, a cooling stage II and a consumer 20.

The pre-cooling stage I is constructed in known manner so as to compress a gas by means of a compressor and to thereafter cool the compressed gas in an after-cooler in order to dissipate the heat of compression. The gas is then cooled to a precooling temperature by heat exchange and expansion with the performance of work.

The cooling stage II serves to further cool the high-pressure gas flow to close to the temperature of the liquefied gas. As indicated, the cooling stage II includes a multi-section heat exchanger 10 which has a plurality of counter-current heat exchangers 1, 2, 3, 4, 5 as well as a plurality of expansion means 15, 19; 22, 25.

In addition, the cooling stage II includes a means, for example in the form of a feed line 11, which connects the pre-cooling stage to the first heat exchanger 1 in order to direct the high pressure gas flow from the pre-cooling stage I to the first heat exchanger 1.

In addition, a means is provided for passing a first sub-flow of a high pressure gas from the heat exchanger 1 to a first expansion means 15 while a further means is provided for passing a second sub-flow of the high pressure gas through the cooling stage. In this regard, the means for passing the first sub-flow includes a branch line 14 which connects the first heat exchanger 1 to the expansion means 15, such as a gas turbine, within which the flow is expanded to a first intermediate pressure and is cooled during this process. The means also includes a plurality of lines 16, 17, 17', 18 which sequentially connect the gas turbine with the heat exchangers 3, 4, 5 and the second expansion means 19 which is in the form of a throttle valve. The expanded gas thus leaves the expansion means 15 via the line 16 and flows through the heat exchanger 3 into the line 17 to the heat exchanger 4. In like matter, the thus cooled gas passes through the line 17', through the heat exchanger 5 and the line 18 to the throttle valve 19 in which the gas is expanded to liquefaction pressure. The resulting mixture of gas and liquid is collected in the consumer 20 which is in the form of a tank which is able to make use of the low temperature.

The means for conducting the second sub-flow through the cooler includes a second plurality of lines 12, 13, 21, 23, 24 which connect the heat exchangers 2, 3, 5 and the second expansion means 25. As indicated, the second sub-flow leaving the heat exchanger 1 passes through the line 12 to the second heat exchanger 2 and thereafter, through the line 13 to the heat exchanger 3. The line 21 passes the cooled gas to the expansion means 22, such as a gas turbine, for expansion therein to an intermediate pressure while being cooled in the process. Thereafter, the cooled gas leaves the gas turbine 22 via line 23 and is passed through the heat exchanger 5 and fed via the line 24 to the expansion means 25 which is in the form of a throttle valve so as to be expanded to liquefaction pressure. This mixture is also collected in the tank 20.

As indicated, the tank 20 has a vapor space 26 which is connected to the pre-cooling stage I via a line 27 which runs through all of the heat exchangers 1–5 of the multi-section heat exchanger 10 of the cooler II in order to carry the low-pressure gas flow. During operation, this low-pressure gas flow reaches the pre-cooling stage I at a temperature just below the pre-cooling temperature. Thus, the high pressure gas flowing through the heat exchangers 1–5 is cooled by heat exchange with the low-pressure flow.

As an alternative, the sub-flows leaving the heat exchanger 5 via the lines 18, 24 may be expanded in other expansion means instead of the throttles 19, 25.

Further, after leaving the pre-cooling stage I, the high pressure gas flow may divide so as to eliminate the need for the first heat exchanger 1.

Figure 2:
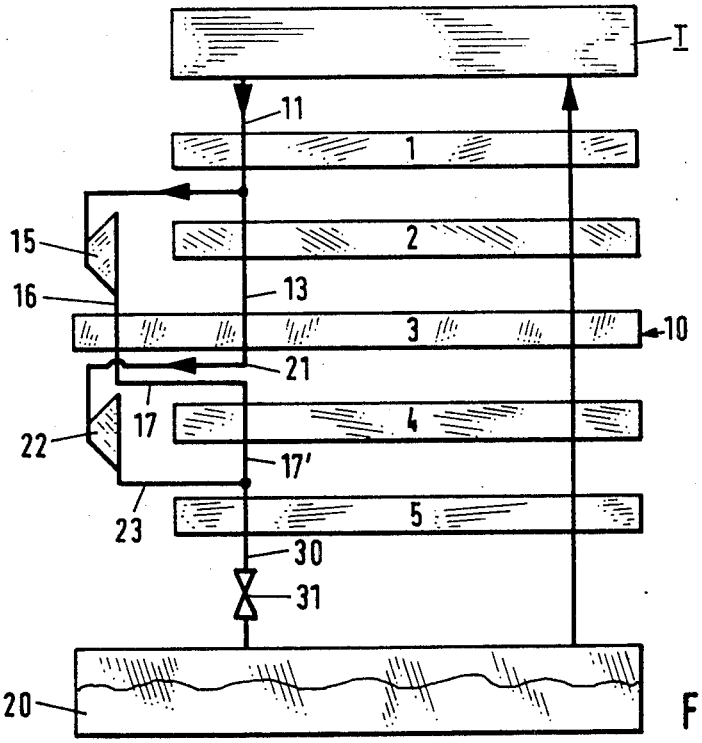
FIG. 2 illustrates a modified apparatus constructed in accordance with the invention.

Referring to FIG. 2 wherein like reference characters indicate like parts as above, the apparatus for liquefying the gas may be constructed so that the expanded gas leaving the expansion means 15, 22 has the same intermediate pressure in each case. In this situation, the line 23 carrying the high-pressure gas which is expanded in the expansion means 22 leads directly into the line 17' carrying the high pressure gas expanded in the expansion means 15 from the heat exchanger 4 to the heat exchanger 5. Further, a single line 30 extends from the heat exchanger 5 to carry the combined gas flows to a throttle valve 31 for expansion to the liquefaction pressure. The resulting mixture of gas and liquid is then collected in the tank 20 as above.

Figure 3:
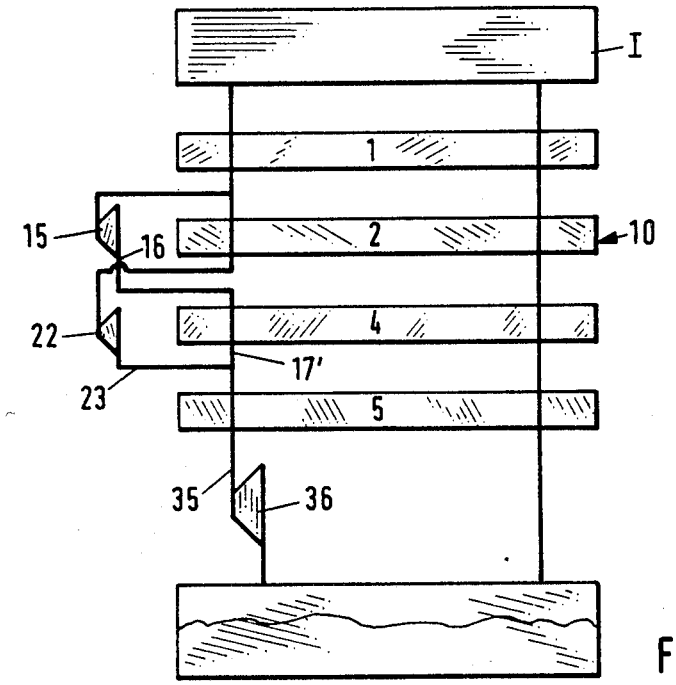
FIG. 3 illustrates a third modified apparatus constructed in accordance with the invention.

Referring to FIG. 3 wherein like reference characters indicate like parts as above, the heat exchanger 10 of the cooler may be made with four sections or stages. As indicated, the third heat exchanger is eliminated. This reduces the number of possible sources of leakage in the heat exchanger and makes the heat exchanger cheaper to manufacture.

As indicated, the sub-flow of gas leaving the expansion means 15 passes through the line 16 directly to the heat exchanger 4. In addition, the sub-flow leaving the expansion means 22 passes via the line 23 into the line 17' between the heat exchangers 4, 5. A discharge line 35 from the heat exchanger 5 leads to an expansion means 36 wherein the combined flow of gas is expanded to liquefaction pressure.

Figure 4:
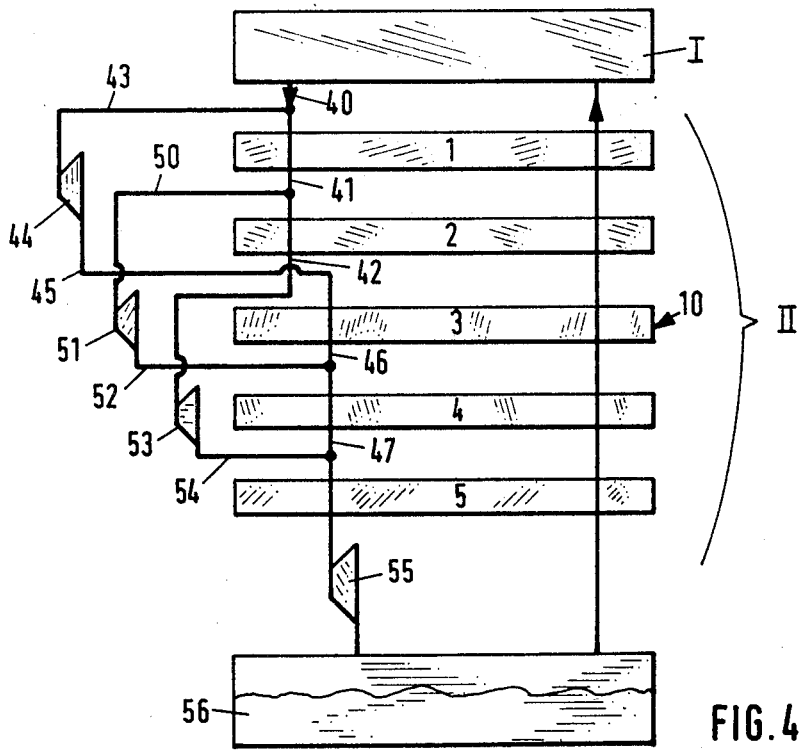
FIG. 4 illustrates a still further modified apparatus constructed in accordance with the invention.

Referring to FIG. 4 wherein like reference characters indicate like parts as above, the apparatus may be constructed so that the high pressure gas flow in the cooling stage II is divided into a number of sub-flows. In this embodiment, a feed line 40 extends from the pre-cooling stage I to the heat exchanger 1 while a branch line 43 extends from the feed line 40 to an expansion means 44. During operation, a first sub-flow of the high pressure gas is conducted by the line 40 to the heat exchanger 1 for cooling purposes. At the same time, the second sub-flow passes via line 43 to the expansion means 44 for expansion and cooling therein.

A line 41 connects the first heat exchanger 1 to the second heat exchanger 2 while a branch line 50 connects the line 41 to a second expansion means 51. During operation, the sub-flow which passes from the heat exchanger 1 is subdivided into a sub-flow which passes into the heat exchanger 2 for cooling therein and another sub-flow which passes through the line 50 to the expansion means 51 for expansion and cooling therein.

A line 42 connects the heat exchanger 2 to a third expansion means 53 for expansion and cooling of the sub-flow passing from the heat exchanger 2.

A sequence of lines 45, 46, 47 connects the expansion means 44 to the heat exchangers 3, 4, 5 so as to convey this sub-flow sequentially through the heat exchangers 3, 4, 5 for cooling purposes. In this regard, the expansion means 44 serves to expand the sub-flow to a first intermediate pressure while being cooled to a first temperature.

A line 52 connects the expansion means 51 to the line 46 between the heat exchangers 3, 4. During operation, the second sub-flow passes from the expansion means 51 via the line 52 into the line 46 so as to be combined with the first sub-flow from the expansion means 44 prior to cooling in the heat exchanger 4, 5. In this regard, the second sub-flow is expanded to a second intermediate pressure in the expansion means 51 while being cooled to a second temperature in the process.

A line 54 connects the expansion means 53 to the line 47 between the heat exchangers 4, 5. During operation, the third sub-flow passes from the expansion means 53 via the line 54 into the line 47 and is combined with the previously combined sub-flows passing from the heat exchanger 4 to the heat exchanger 5. In this regard, the sub-flow is expanded to a third intermediate pressure in the expansion means 53 while being cooled to a third temperature.

The sub-flows of gas which are expanded and cooled in the three expansion means 44, 51, 53 are combined and passed together through the heat exchanger 5 to an expansion means 55 in which the complete flow is expanded to liquefaction pressure. The resulting gas and liquid gas mixture is then collected in a tank 56, as above.

Of note, the three expansion means 44, 51, 53 can be constructed so that the temperature ranges formed by the input and expansion temperature overlap.

The invention thus provides a relatively simple apparatus and method for liquefying a low-boiling gas such as helium. In this regard, the apparatus provides a relatively high degree of thermodynamic efficiency by dividing the high pressure gas flow into a plurality of sub-flows which are each expanded and cooled in heat exchange with the low pressure flow which is re-cycled from the consumer to the pre-cooling stage.

What is claimed is:

1. A method of liquefying a low-boiling gas in a circuit having a pre-cooling stage for producing a high pressure gas flow at a pre-cooling temperature; a cooling stage for cooling the high pressure flow to close to the temperature of liquefied gas, said cooling stage including a plurality of counter-current heat exchangers and a plurality of expansion means; and a low temperature consumer for receiving at least some liquefied gas from said cooling stage and for re-cycling a low-pressure gas flow to said cooling stage, said method comprisini the steps of passing the high pressure flow from the precooler through a first of the heat exchangers in the cooler;

dividing the flow into two sub-flows;

expanding one of the sub-flows in a first of the expansion means to a first intermediate pressure with the performance of work;

directing the second sub-flow through a second of the heat exchangers;

passing the two sub-flows through a third of the heat-exchangers simultaneously and separately from one another;

directing said second sub-flow from the third heat-exchanger through a second of the expansion means for expansion to a second intermediate pressure with the performance of work;

directing said first sub-flow from the third heat-exchanger through a fourth of the heat exchangers;

thereafter passing said two sub-flows through a fifth of the heat exchangers simultaneously and separately from one another; and then expanding said two sub-flows in an expansion means to the pressure of the low-pressure flow, at least some liquid gas being formed and being fed to the low-temperature consumer.

2. A method as set forth in claim 1 wherein said first and second intermediate pressures have the same value and the second sub-flow from the second expansion means and the first sub-flow from the fourth heat-exchanger pass through the fifth heat-exchanger in combination and then are expanded in a common throttle valve.

3. A method of liquefying a low-boiling gas in a circuit having a pre-cooling stage for producing a high pressure gas flow at a pre-cooling temperature; a cooling stage for cooling the high pressure flow to close to the temperature of liquefied gas, said cooling stage including a plurality of counter-current heat exchangers and a plurality of expansion means; and a low-temperature consumer for receiving at least some liquefied gas from said cooling stage and for re-cycling a low-pressure gas flow to said cooling stage;

passing the high pressure flow from the precooler through a first of the heat exchangers in the cooler;

dividing the flow into two sub-flows;

expanding one of the sub-flows in a first of the expansion machines to a first intermediate pressure with the performance of work;

directing the second sub-flow through a second of the heat exchangers;

passing the expanded first sub-flow through a third of the heat exchangers;

thereafter combining the first sub-flow from the third heat exchanger and the second sub-flow from the second heat exchanger;

then passing the combined sub-flows to a fourth of the heat exchangers; and then expanding the combined flows in an expansion means to the pressure of the low-pressure flow, at least some liquid gas being formed and being fed to the low-temperature consumer.

4. A method of liquefying a low-boiling gas in a circuit having a pre-cooling stage for producing a high pressure gas flow at a pre-cooling temperature; a cooling stage for cooling the high pressure flow to close to the temperature of liquefied gas, said cooling stage including a plurality of counter-current heat exchangers and a plurality of expansion means; and low-temperature consumer for receiving at least some liquefied gas from said cooling stage and for re-cycling a low-pressure gas flow to said cooling stage;

dividing the high pressure flow from the precooler into two sub-flows;

expanding a first sub-flow in a first of the expansion means to a first intermediate pressure and a first temperature with the performance of work;

passing the second sub-flow through a first of the heat-exchangers;

dividing the second sub-flow from the first heat-exchanger into a third sub-flow and a fourth sub-flow;

expanding the third sub-flow in a second of the expansion means to a second intermediate pressure and a second temperature with the performance of work;

passing the fourth sub-flow through a second of the heat exchangers;

expanding the fourth sub-flow from the second heat-exchanger to a third intermediate pressure and a third temperature in a third of the expansion means with the performance of work;

passing the first sub-flow from the first expansion means through a third of the heat exchangers;

passing the third sub-flow from the second expansion means and the first sub-flow from the third heat-exchanger through a fourth of the heat-exchangers in combination;

then passing the fourth sub-flow from the third expansion means and the flow from the fourth heat exchanger through a fifth of the heat exchangers in combination; and expanding the flow from the fifth heat-exchanger in an expansion means to the pressure of the low-pressure flow, at least some liquid gas being formed and being fed to the low-temperature consumer.

5. A method as set forth in claim 4 wherein the the temperature ranges formed by the input and expansion temperatures of the expansion means overlap.

6. Apparatus for liquefying a low-boiling gas in a circuit comprising a pre-cooling stage for producing a high pressure gas flow at a pre-cooling temperature;

a cooling stage for cooling the high pressure flow too close to the temperature of liquefied gas, said cooling stage including a plurality of counter-current heat exchangers and a plurality of expansion means;

a low-temperature consumer for receiving at least some liquefied gas from said cooling stage and for re-cycling a low-pressure gas flow to said cooling stage;

first means for directing the high pressure gas flow from said pre-cooling stage through a first heat exchanger in said cooling stage;

second means for passing a first sub-flow of the high pressure gas flow through a first expansion means in said cooler for expansion therein, at least two other heat exchangers in said cooler for cooling the expanded gas flow in counter-current to a flow of the low-temperature gas flow therein and a second expansion means in said cooler for expansion therein prior to delivery to said consumer; and third means for passing a second sub-flow of the high pressure gas flow through two heat exchangers in said cooler for cooling in counter-current to the flow of low-temperature gas, a third expansion means between said two heat exchangers for expansion therein and a further expansion means for expanding the gas flow prior to delivery to said consumer.

7. An apparatus as set forth in claim 6 wherein said first means includes a feed line connecting said precooling stage to said first heat exchanger.

8. An apparatus as set forth in claim 7 wherein said second means includes a branch line connecting said first heat exchanger to said first expansion means and a first plurality of lines sequentially connecting said two heat exchangers and said second expansion means.

9. An apparatus as set forth in claim 7 wherein said third means includes a second plurality of lines connecting said first heat exchanger, said two heat exchangers and said third expansion means.

10. An apparatus as set forth in claim 9 wherein a common means forms said further expansion means and said second expansion means to pass said sub-flows to said consumer together.

11. An apparatus as set forth in claim 10 wherein said common means is a throttle valve.

12. An apparatus as set forth in claim 10 wherein said common means is an expansion turbine.

13. An apparatus as set forth in claim 9 wherein said second means and said third means pass said sub-flows in parallel from said cooler to said consumer.

14. An apparatus as set forth in claim 6 which further comprises a branch line connected to said first means to convey a third sub-flow of the high pressure gas flow therefrom, a gas turbine connected to said branch line to expand said third sub-flow and a line connecting said gas turbine to said second means downstream of said first expansion means.

15. An apparatus as set forth in claim 14 wherein a common means forms said further expansion means and said second expansion means.

16. Apparatus for liquefying a low-boiling gas in a circuit comprising a pre-cooling stage for producing a high pressure gas flow at a pre-cooling temperature;

a cooling stage for cooling the high pressure flow to close to the temperature of liquefied gas, said cooling stage including a plurality of counter-current heat exchangers and a plurality of expansion means;

a low-temperature consumer for receiving at least some liquefied gas from said cooling stage and for re-cycling a low-pressure gas flow to said cooling stage;

a first plurality of lines for passing a first sub-flow of the high pressure gas flow sequentially through a first of said expansion means and at least two heat exchangers downstream of said first expansion means; and a second plurality of lines for passing a second sub-flow of the high pressure gas flow sequentially through at least one of said heat exchangers, a second of said expansion means and at least one other of said heat exchangers.

* * * * *

UNITED STATES PATENT AND TRADEMARK OFFICE

CERTIFICATE OF CORRECTION

PATENT NO. : 4,606,744

DATED : August 19, 1986

INVENTOR(S) : ANDRES KUNDIG

It is certified that error appears in the above-identified patent and that said Letters Patent is hereby corrected as shown below:

Column 4, line 33 "seccnd" should be -second-

Column 5, line 33 "comprisini" should be - comprising-

Column 7, line 3 "wherein the the" should be -wherein the-

Column 7, line 10 "too" should be -to-

Signed and Sealed this

Seventeenth Day of February, 1987

*Attest:*

DONALD J. QUIGG

*Attesting Officer*

*Commissioner of Patents and Trademarks*